US011415139B2

(12) United States Patent
Key et al.

(10) Patent No.: US 11,415,139 B2
(45) Date of Patent: Aug. 16, 2022

(54) COMPRESSOR STALL WARNING USING NONLINEAR FEATURE EXTRACTION ALGORITHMS

(71) Applicant: Purdue Research Foundation, West Lafayette, IN (US)

(72) Inventors: Nicole Leanne Key, West Lafayette, IN (US); Fangyuan Lou, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 194 days.

(21) Appl. No.: 16/918,054

(22) Filed: Jul. 1, 2020

(65) Prior Publication Data

US 2022/0018352 A1 Jan. 20, 2022

Related U.S. Application Data

(60) Provisional application No. 62/871,219, filed on Jul. 8, 2019.

(51) Int. Cl.
*F04D 27/00* (2006.01)

(52) U.S. Cl.
CPC ..... *F04D 27/001* (2013.01)

(58) Field of Classification Search
CPC . F04D 27/001; F05D 2260/81; F05D 2260/80
See application file for complete search history.

(56) References Cited

U.S. PATENT DOCUMENTS

| | | | | |
|---|---|---|---|---|
| 4,578,756 | A * | 3/1986 | Rosenbush | F02C 9/00 701/100 |
| 7,027,953 | B2 * | 4/2006 | Klein | G01H 1/006 702/182 |
| 9,074,606 | B1 * | 7/2015 | Moore | F04D 19/02 |
| 10,422,774 | B2 * | 9/2019 | Araki | G01N 29/14 |
| 2005/0096873 | A1 * | 5/2005 | Klein | G01H 1/006 702/184 |
| 2007/0089440 | A1 * | 4/2007 | Singh | F25B 49/005 62/228.3 |
| 2010/0168931 | A1 * | 7/2010 | Nasle | G06F 30/20 700/291 |
| 2011/0208539 | A1 * | 8/2011 | Lynn | G16H 50/30 708/422 |

(Continued)

*Primary Examiner* — Freddie Kirkland, III
(74) *Attorney, Agent, or Firm* — Purdue Research Foundation

(57) ABSTRACT

The present disclosure relates to a novel method to detect an imminent compressor stall by using nonlinear feature extraction algorithms. The present disclosure focuses on the small nonlinear disturbances prior to deep surge and introduces a novel approach to identify these disturbances using nonlinear feature extraction algorithms including phase-reconstruction of time-serial signals and evaluation of a parameter called approximate entropy. The technique is applied to stall data sets from a high-speed centrifugal compressor that unexpectedly entered rotating stall during a speed transient and a multi-stage axial compressor with both modal- and spike-type stall inception. In both cases, nonlinear disturbances appear, in terms of spikes in approximate entropy, prior to surge. The presence of these pre-surge spikes indicates imminent compressor stall.

10 Claims, 10 Drawing Sheets

(56) References Cited

U.S. PATENT DOCUMENTS

| | | | | |
|---|---|---|---|---|
| 2011/0247418 | A1* | 10/2011 | Hoyte | F01D 17/02 415/118 |
| 2016/0363127 | A1* | 12/2016 | Lee | F04D 27/001 |
| 2017/0227505 | A1* | 8/2017 | Araki | F04D 27/001 |
| 2021/0285457 | A1* | 9/2021 | Iwakiri | F04D 27/0207 |
| 2021/0341223 | A1* | 11/2021 | Goryachikh | F25J 1/0022 |

* cited by examiner

N-point time scalar signal, x(t): $\{x_1, x_2, x_3, x_4, \ldots x_i, \ldots x_N\}$ Vectors in m-dimensional space, $\{\mathbf{x}_k\}$:

$\mathbf{x}_1 = (x_1, x_{1+t}, x_{1+2t}, \ldots x_{1+(m-1)t})$ $\mathbf{x}_2 = (x_2, x_{2+t}, x_{2+2t}, \ldots x_{2+(m-1)t})$ $\vdots$ $\mathbf{x}_k = (x_k, x_{k+t}, x_{k+2t}, \ldots x_{k+(m-1)t})$, $1<k<M$ $\vdots$ $\mathbf{x}_M = (x_M, x_{M+t}, x_{M+2t}, \ldots x_{M+(m-1)t})$, $M=N-(m-1)t$ (a) (b)

(a) (b)

(c)

COMPRESSOR STALL WARNING USING NONLINEAR FEATURE EXTRACTION ALGORITHMS

This application claims the benefit of U.S. Provisional Application Ser. No. 62/871,219, filed on Jul. 8, 2019. The entire disclosure of the above application is hereby incorporated herein by reference.

TECHNICAL FIELD

The present disclosure relates to a novel method to detect an imminent compressor stall by using nonlinear feature extraction algorithms.

BACKGROUND

This section introduces aspects that may help facilitate a better understanding of the disclosure. Accordingly, these statements are to be read in this light and are not to be understood as admissions about what is or is not prior art.

One challenge that has plagued the development of gas turbine engines, from early designs to the advanced engines of the present day, is stall and surge. Stall is a type of flow instability in compressors which sets the low flow limit for compressor operation. As a result of the potentially damaging consequences of entering stall, extensive research has been performed on stall inception, stall detection, and stall control. Despite the enhanced understanding of stall inception mechanisms (i.e. modes or spikes), there has been limited progress achieved towards reliable stall warning or effective stall suppression.

The approaches for stall warning that focus on pre-stall flow irregularities can be categorized into the correlation approach or the ensemble-average approach. The correlation approach utilizes a parameter, known as the correlation measure, to gauge the repeatability of the pressure signature associated with blade passing event. It has been found that there is a drop in the value of correlation measure as stall approached, and the same trend was observed in both low- and high-speed compressors. In a later study, a stochastic model of the correlation measure was also introduced, in which each drop in repeatability in the blade passing signature (correlation measure) is defined as an "event", and a statistical parameter, "event rate" is measured to gauge the margin of a compressor operating condition from stall. It has been found that the event rate ramped up rapidly as the compressor flow rate was reduced towards the stall point. In addition to model development, efforts have been made to implement the approach into engine active control systems Different from the correlation measure, the ensemble-average approach has been used to characterize the blade passing irregularities: the differences of individual blade passing signatures are compared with an ensemble averaged blade passing signature and characterized by the root mean square (rms) value of the difference. Then, the mean of the rms differences is evaluated to characterize the flow irregularities associated with the blade passing signature. Similar to the increasing "event rate" as stall approaches, there is an increase in the intensity of irregularity of the blade pass signature as the compressor is throttled toward stall. The increase in irregularity in the blade passing signature may be highly dependent on both the tip-clearance size and eccentricity. For example, a compressor with small, uniform, tip-clearance would result in a modest increase in blade passing irregularity while a compressor with large, uniform, tip-clearance would give a sharp rise in irregularity at all circumferential locations with a reduction in compressor flow rate. In contrast, for a compressor with an eccentric tip clearance, the increase in irregularity with a reduction in compressor flow rate will only occur in the section of the annulus of largest tip clearance instead of at all circumferential locations. Therefore, for compressors in aero engines, which can experience an increase in tip clearance over its service span, as well as eccentric tip clearance during a flight cycle, stall warning based on blade passing signature irregularity poses a challenge. For example, a stall warning system based on one pressure transducer at a fixed location would fail to give reliable results for compressors featuring an eccentric tip clearance. On the other hand, the use of multiple transducers at different locations could lead to any number of false alarms. Therefore, a stall warning system based on blade passing signature irregularity would be very challenging to implement in an aero-engine due to changes in tip-clearance size and eccentricity during each flight cycle, or overall life cycle, of the compressor.

Therefore, novel methods to detect an imminent compressor stall are still needed.

SUMMARY

The present disclosure relates to a novel method to detect an imminent compressor stall by using nonlinear feature extraction algorithms.

In one embodiment, the present disclosure provides a method of detecting an imminent compressor stall, wherein the method comprises:

providing a compressor to be monitored;

providing a plurality of casing-mounted pressure transducer on the compressor to collect time-series data, wherein the time-series data is related to instantaneous pressure signal obtained by the casing-mounted pressure transducer;

collecting the time-series data;

applying a phase space reconstruction to the time-series data to generate a multi-dimensional space;

evaluating approximate entropy; and identifying a flow disturbance by the change of the approximate entropy to determine the imminent compressor stall, wherein the flow disturbance happens prior to the compressor stall and is used as a compressor stall warning signal.

DETAILED DESCRIPTION

Figure 1:
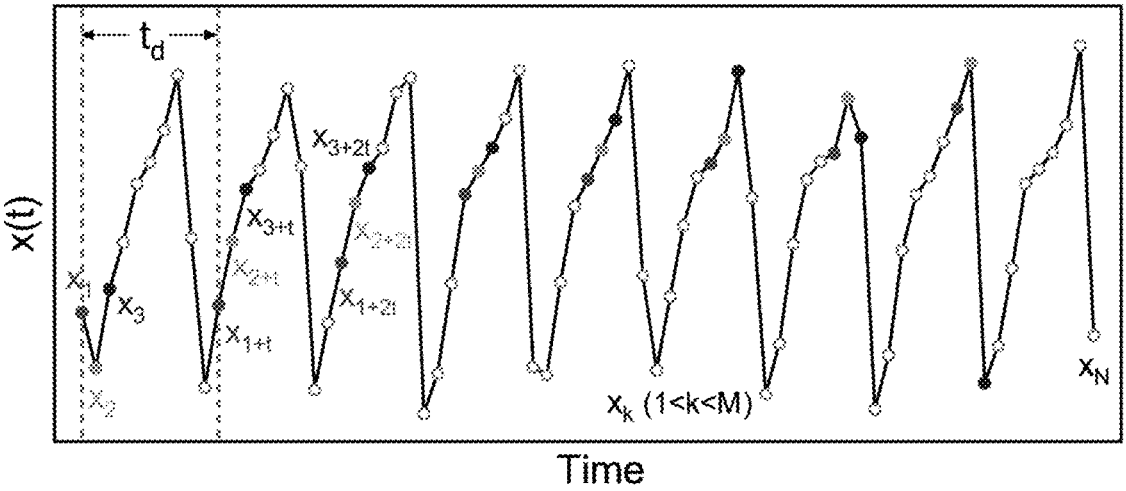
FIG. 1 illustrates phase construction of time series signal.

For the purposes of promoting an understanding of the principles of the present disclosure, reference will now be made to embodiments illustrated in drawings, and specific language will be used to describe the same. It will nevertheless be understood that no limitation of the scope of this disclosure is thereby intended.

In the present disclosure the term "about" can allow for a degree of variability in a value or range, for example, within 10%, within 5%, or within 1% of a stated value or of a stated limit of a range.

In the present disclosure the term "substantially" can allow for a degree of variability in a value or range, for example, within 90%, within 95%, or within 99% of a stated value or of a stated limit of a range.

Stall is a type of flow instability in compressors that sets the low flow limit for compressor operation. During the past few decades, efforts to develop a reliable stall warning system have had limited success. This disclosure focuses on the small nonlinear disturbances prior to deep surge and introduces a novel approach to identify these disturbances using nonlinear feature extraction algorithms including: phase-reconstruction of time-serial signals and evaluation of a parameter called approximate entropy. The technique is applied to stall data sets from two different compressors: a high-speed centrifugal compressor that unexpectedly entered rotating stall during a speed transient and a multi-stage axial compressor with both modal- and spike-type stall inception. In both cases, nonlinear disturbances appear, in terms of spikes in approximate entropy, prior to surge. The presence of these pre-surge spikes indicates imminent compressor stall.

In one embodiment, the present disclosure provides a method of detecting an imminent compressor stall, wherein the method comprises:

- providing a compressor to be monitored;
- providing a plurality of casing-mounted pressure transducer on the compressor to collect time-series data, wherein the time-series data is related to instantaneous pressure signal obtained by the casing-mounted pressure transducer;
- collecting the time-series data;
- applying a phase space reconstruction to the time-series data to generate a multi-dimensional space;
- evaluating approximate entropy; and
- identifying a flow disturbance by the change of the approximate entropy to determine the imminent compressor stall, wherein the flow disturbance happens prior to the compressor stall and is used as a compressor stall warning signal.

In one embodiment regarding the method of detecting an imminent compressor stall, the flow disturbance comprises a nonlinear feature.

In one embodiment regarding the method of detecting an imminent compressor stall, the nonlinear feature of the disturbance is preserved in the instantaneous pressure signal acquired from said casing-mounted transducers.

In one embodiment regarding the method of detecting an imminent compressor stall, the flow disturbance used as a compressor stall warning signal can be detected using a nonlinear feature extraction algorithm.

In one embodiment regarding the method of detecting an imminent compressor stall, the nonlinear feature extraction algorithm comprises phase-space reconstruction and evaluation of approximate entropy.

In one embodiment regarding the method of detecting an imminent compressor stall, the phase space reconstruction is performed using inputs of a time delay ($t_d$) and an embedding dimension (m).

In one embodiment regarding the method of detecting an imminent compressor stall, the time-series data is a set of data of N-point $\{x_i\}$, i=1, 2, . . . , N, the multi-dimensional space obtained from a time-series data of N-point $\{x_i\}$, i=1, 2, . . . , N, is defined as:

$$x_k=(x_k,x_{k+t},x_{k+2t}, \ldots ,x_{k+(n-1)t})$$

$$x_k \in R^m, k=1,2, \ldots M,$$

wherein m is embedding dimension, t is the index lag, and M=N−(m−1)t is the number of embedded points in m-dimensional space.

In one embodiment regarding the method of detecting an imminent compressor stall, the evaluating of the approximate entropy comprises use of four parameters selected from the group of data size (N) embedding dimension (m), time delay ($t_d$), and radius of similarity (r).

In one embodiment regarding the method of detecting an imminent compressor stall, the approximate entropy is calculated as:

$$\mathrm{ApEn}(m,r,N)=\Phi^m(r)-\Phi^{m+1}(r)$$

wherein:

$$\Phi^m(r) = \frac{1}{M}\sum_{k=1}^{M} \log C_k^m(r);$$

$$C_k^m = \frac{1}{M}\sum_{j=1}^{M} \Theta(r - \|x_k - x_j\|),$$

wherein $\Theta(a)=0$, if $a<0$, $\Theta(a)=1$, if $a\geq 0$; and $\|x_k-x_j\|=\max(|x_k(i)-x_j(i)|)$, k=1, 2, . . . m In one embodiment regarding the method of detecting an imminent compressor stall, the nonlinear disturbance used as a compressor stall warning signal results in a sudden change in the value of approximate entropy.

Methodology

The nonlinear feature extraction algorithm used in the present disclosure includes phase reconstruction of time-series data and evaluation of approximate entropy. The parameter, approximate entropy (ApEn), has nothing to do with thermodynamic entropy. Rather, it is a statistical parameter that measures the amount of regularity and unpredictability of fluctuations in a time-series data. A time series with more repetitive patterns of fluctuations renders smaller approximate entropy values and vice versa. The parameter was first introduced by Pincus. See Pincus, S. M., 1991, "Approximate Entropy as a Measure of System Complexity", Proc. Natl. Acad. Sci. 88(3), pp. 2297-2301. Unlike other exact regularity statistics, including correlation dimension algorithms and various entropy measures which require a vast amount of data and are discontinuous to system noise, approximate entropy can discern changing complexity in a system with a relatively small amount of data. This makes it an attractive parameter to explore considering the long-term goal of developing an in-flight stall warning system.

Phase Space Reconstruction

The first step in implementing the non-linear feature algorithm is the attractor reconstruction. In other words, the time-series data (i.e. instantaneous pressure signal) must be constructed into a multi-dimensional space. The method of delays has become popular for attractor reconstruction in many fields of science and engineering. In the present study, the phase space reconstruction of the time-domain signal is performed using inputs of a time delay and an embedding dimension. For example, the time-domain signal of N-point $\{x_i\}$, i=1, 2, . . . , N, is embedded into an m-dimensional space as follows:

$$x_k=(x_k,x_{k+t},x_{k+2t}, \ldots ,x_{k+(m-1)t})$$

$$x_k \in R^m, k=1,2, \ldots M, \tag{1}$$

where m is the embedding dimension, t is the index lag, and M=N−(m−1)t is the number of embedded points in m-dimensional space. The time delay for a signal of sampling frequency, $f_s$, is $t_d=t/f_s$. An illustration for phase construction of a time series data is shown in FIG. 1.

According to Takens's theorem, the choice of time delay could almost be arbitrary for an infinite noise-free data set. However, for real data sets with the presence of noise and finite size, delay time plays an important role in the reconstruction of the attractor. For example, Casdagli et al. showed compressed reconstructed attractor (redundance) for an undersized time delay and discontinued attractor dynamics (irrelevance) for an oversized time delay. See Casdagli, M., Eubank, S., Farmer, D. J., and Gibson, J., 1991, "State Space Reconstruction in the Presence of Noise," Physica D: Nonlinear Phenomena, 51(1-3), pp. 52-98. There are several commonly used approaches for selection of time delay. One widely used method is the autocorrelation function. However, it has been pointed out that the autocorrelation function may not be appropriate for nonlinear systems, and instead, $t_d$ should be chosen as the first local minimum of the mutual information. See Fraser, A. M. and Swinney, H. L., 1986, "Independent Coordinates for Strange Attractors from Mutual Information," Phys. Rev., A, 33(2), pp. 1134-1140.

Approximate Entropy

To calculate approximate entropy, for each $x_k$ (k=1, 2, . . . M) in the constructed m-dimensional space, define $$C_k^m = \frac{1}{M}\sum_{k=1}^{M}\Theta(r - \|x_k - x_j\|), \tag{2}$$

wherein Θ(a)=0, if a<0, Θ(a)=1, if a≥0, $$\|x_k-x_j\|=\max(|x_k(i)-x_j(i)|),k=1,2, \ldots m, \tag{3}$$

wherein $C_k^m$ represents the fraction of pairs of points whose maximum difference in their respective scalar components (also known as the sup-norm) separation with respect to $x_k$ is no greater than r, where r is the radius of similarity.

The approximate entropy is then calculated as:

$$\mathrm{ApEn}(m,r,N)=\Phi^m(r)-\Phi^{m+1}(r), \tag{4}$$

wherein $$\Phi^m(r) = \frac{1}{M}\sum_{k=1}^{M}\log C_k^m(r). \tag{5}$$

There are four parameters involved in evaluating the approximate entropy including: data size, N, embedding dimension, m, time delay, $t_d$, and radius of similarity, r. In the present disclosure, the effects of different choices for these parameters are evaluated and presented in the following section.

Results From Analysis of Compressor Data

This section presents a summary of results from two case studies using the nonlinear feature extraction algorithm. Analyses were performed using data sets acquired at two compressor research facilities at Purdue University including a high-speed single stage centrifugal compressor and a three-stage axial compressor facility. For the high-speed centrifugal compressor, stall was encountered unexpectedly during speed transients. The three-stage axial compressor features both modal- and spike-type stall inception depending on the rotor tip clearance levels. Therefore, these data sets provide a unique opportunity of examining the capability of the nonlinear feature extraction algorithm for different pre-stall signatures as well as different modes of operations (transient versus quasi-steady state).

High-Speed Centrifugal Compressor with Rotating Stall During Speed Transients

The nonlinear feature extraction algorithm is first applied to data acquired on a high-speed single-stage centrifugal compressor, which experienced unexpected rotating stall during speed sweeps. The compressor stage has a configuration representative of aero engine applications. The compressor has a design speed around 45,000 rpm and produces a total pressure ratio near 6.5 at the design condition. The compressor was instrumented with both steady flow and fast-response instrumentation. Total pressure and total temperature rakes were installed at the compressor inlet and exit to characterize the compressor performance. Fast-response transducers were placed along the outer diameter of the flow path from impeller leading edge (LE) to downstream of the diffuser throat for detecting the location of stall inception. Details of the research facility, including instrumentation, can be found in Lou, F., Harrison, H. M., Fabian, J. C., Key, N. L., James, D. K., and Srivastava, R., 2016, "Development of a Centrifugal Compressor Facility for Performance and Aeromechanics Research," ASME Paper No. GT2016-56188.

Compressor speed sweeps (from sub-idle to full speed) were performed at four throttle positions (from choke to near surge). Each sweep starts with an acceleration ramp and ends with a deceleration ramp. A constant sweep rate was used for all sweeps. The throttle position for each sweep is listed in Table 1. Both compressor transient performance and unsteady pressure along the flow path were real-time monitored and continuously recorded during the speed sweeps.

TABLE 1

Parameters for sweep testing

| Parameter | Value |
|---|---|
| Minimum Speed (rpm) | 25,000 |
| Maximum Speed (rpm) | 48,000 |

TABLE 1-continued

| Parameters for sweep testing | |
|---|---|
| Parameter | Value |
| Sweep Rate (rpm/sec) | 66.7 |
| Throttle Position (% close) | 21.6 |
| | 29.0 |
| | 34.0 |
| | 36.2 |

Figure 2:
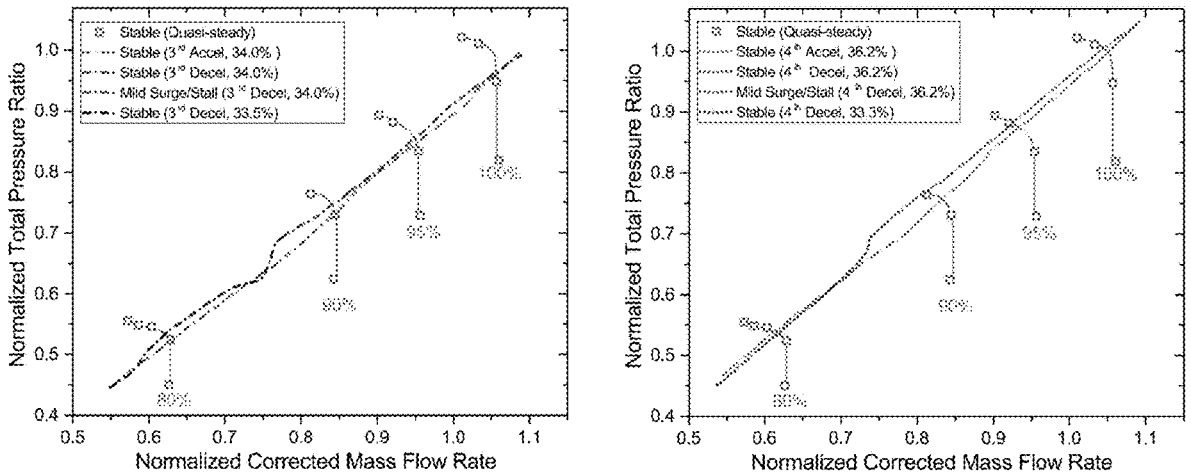
FIG. 2 illustrates compressor transient performance in TPR during the $3^{rd}$ sweep (a) $4^{th}$ sweep (b).

FIG. 2 shows the compressor transient performance during the $3^{rd}$ and $4^{th}$ sweeps at constant throttle settings of 34.0% and 36.2%, where a higher percentage indicates a more closed throttle and, thus, a higher compressor loading. Compressor transient performance is characterized by total pressure ratio using the area-averaged flow properties measured at the compressor inlet and exit. The difference in the compressor transient performance is associated with the heat transfer between the flow and the hardware. Heat is extracted from the flow to warm up the compressor hardware during accelerations while heat is added to the flow during decelerations. There is no flow instability observed during either of the accelerations, however, flow instability occurs unexpectedly during decelerations near 90% corrected speed (red dash-dot lines). In both cases, the compression system recovers to stable operating conditions (blue lines) once the throttle valve is opened.

Figure 3:
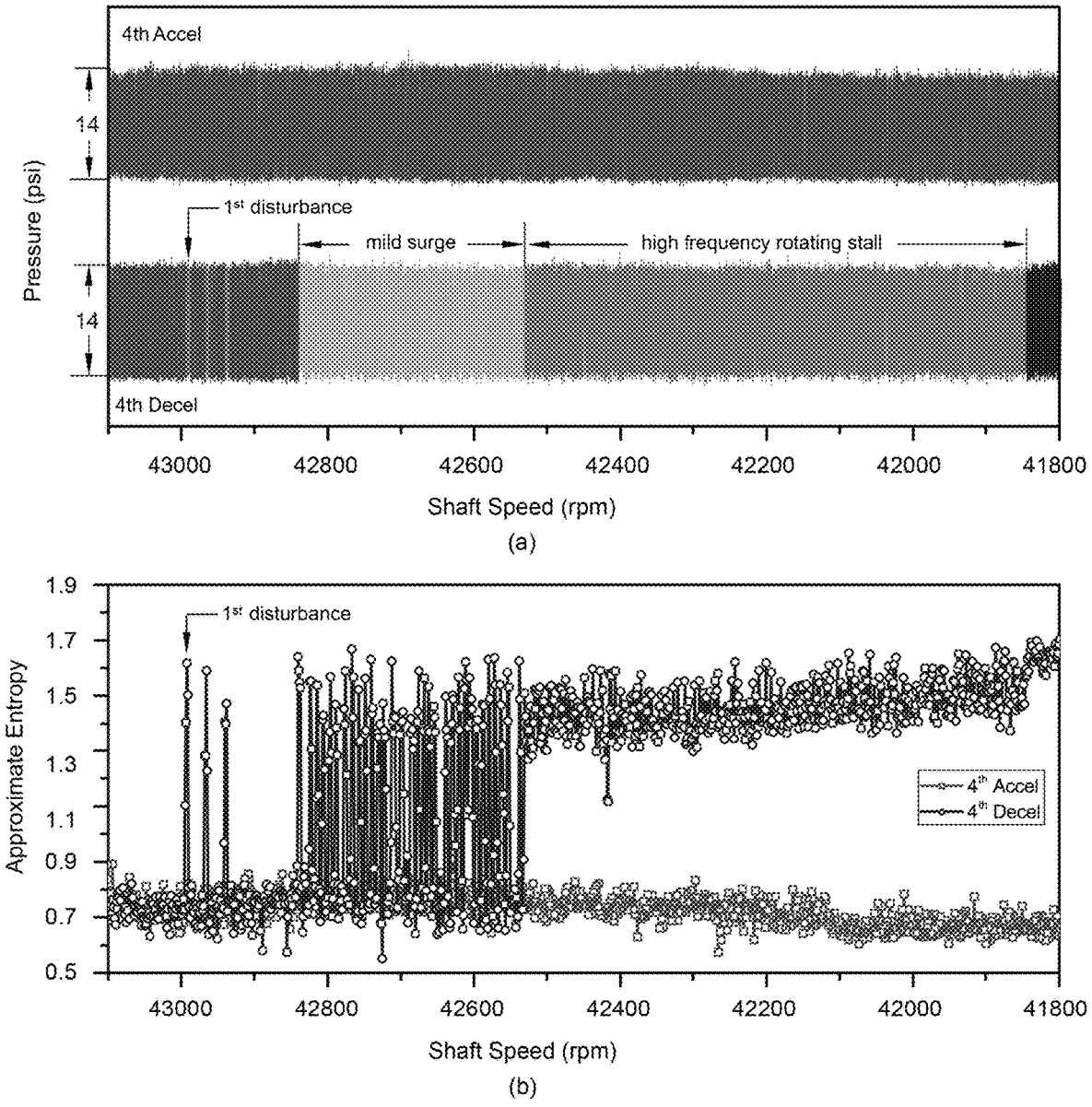
FIG. 3 illustrates impeller leading edge unsteady pressure traces (a) and the corresponding approximate entropy (b) along the path into instability during the $4^{th}$ deceleration.

During compressor sweeps, the unsteady pressure from the casing-mounted fast-response pressure transducers was continuously recorded. A sample rate of 100 kHz was used, which provides approximately 1300 data points per rotor revolution near 90% corrected speed (where the flow instability occurs). FIG. 3*a* shows the instantaneous pressure traces obtained at the impeller leading edge during the $4^{th}$ sweep. The abscissa is time in compressor speed, and the ordinate is the static pressure. In contrast to the stable operation during the acceleration, flow instability occurred during the deceleration. It first arrives in the form of discrete stall bursts (olive), then slips into mild surge (orange), and quickly develops into continuous high-frequency stall (red). The compressor stays in the stalled condition for approximately 5800 revolutions (8 seconds) and returns to stable operation (blue) after opening the throttle. FIG. 3*b* shows the corresponding approximate entropy of the instantaneous pressure traces during the $4^{th}$ sweep. The approximate entropy results shown in FIG. 3 and FIG. 4 were obtained with data from 10 rotor revolutions, an embedding dimension m=2, radius of similarity $r=0.2\sigma$ (where $\sigma$ is the standard deviation of the data set), and time delay obtained from the average mutual information (AMI) method. An exercise of different choices for these parameters was performed, and this set of parameters provided the best extraction of the disturbances associated with flow instabilities.

The approximate entropy of the unsteady pressure measurement during the acceleration without flow instabilities stays fairly constant. In contrast, the approximate entropy of the unsteady pressure measurement spikes during the deceleration as the flow instabilities occur. The approximate entropy during the first disturbance is more than two times larger than the approximate entropy at the stable operating conditions. During the phase of mild surge (orange color in FIG. 3*a*), spikes in approximate entropy occur more frequently. Finally, the approximate entropy remains at a similar level as that of the first disturbance during the phase of high-frequency rotating stall.

Figure 4:
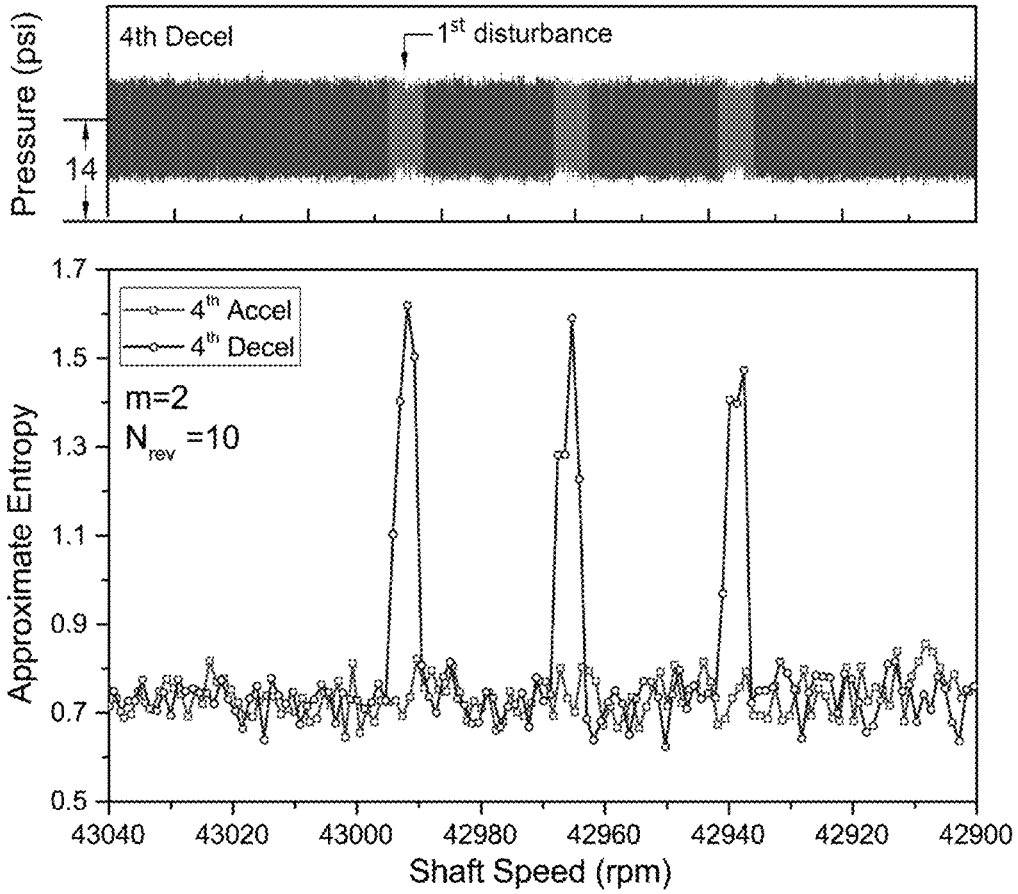
FIG. 4 illustrates impeller leading edge instantaneous pressure traces (a) and the corresponding approximate entropy (b) along the path into the first disturbance during the $4^{th}$ deceleration.

For the purpose of stall warning, it is of most interest to capture that first disturbance. Thus, results over a smaller range of speed transients focusing on the occurrence of the first few disturbances are shown in FIG. 4. The top plot shows the instantaneous pressure traces acquired at the impeller leading edge, and the bottom plot shows the corresponding approximate entropy. The spikes in approximate entropy align perfectly with the disturbances shown in the pressure traces.

Figure 5:
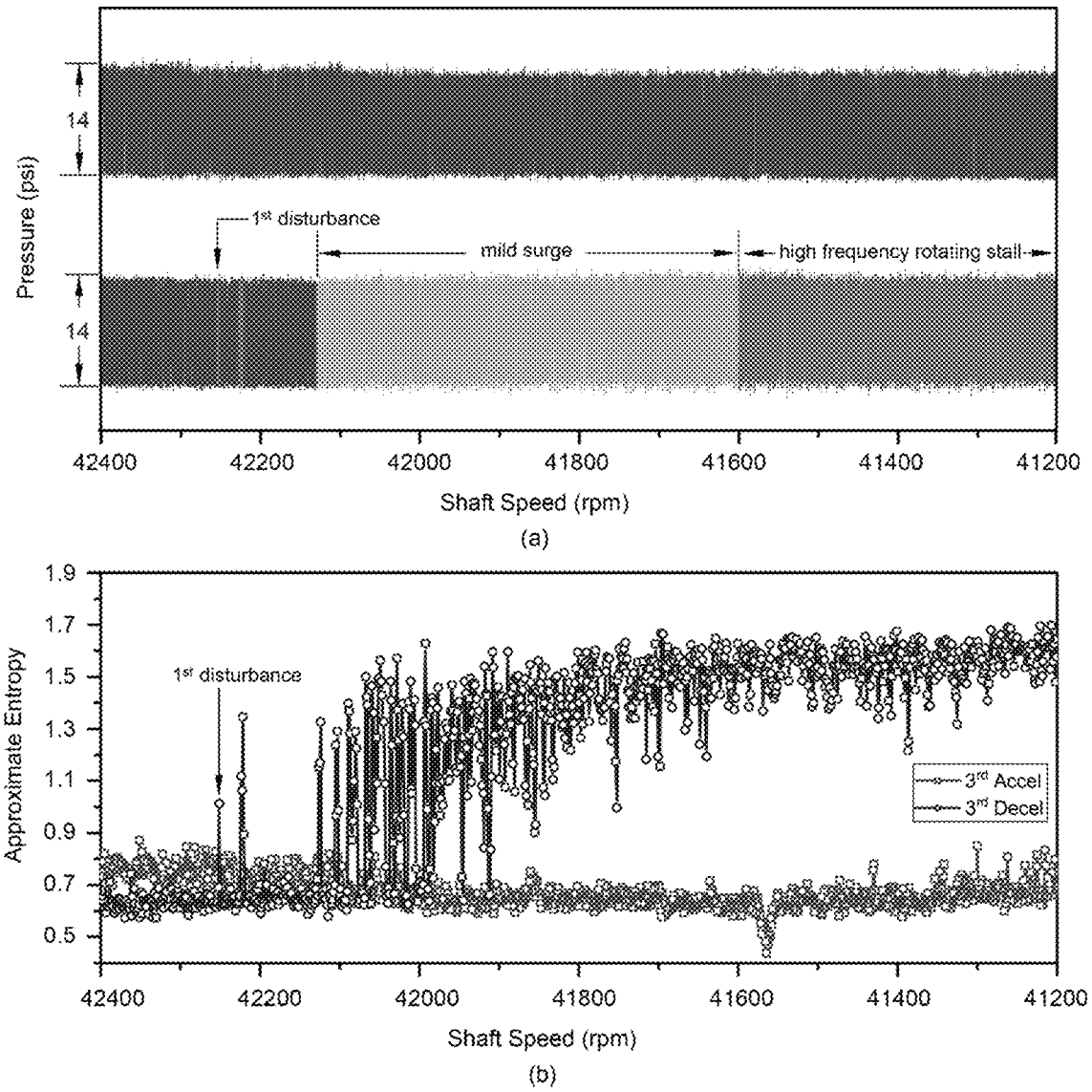
FIG. 5 illustrates impeller leading edge unsteady pressure traces (a) and the corresponding approximate entropy (b) along the path into instability during the $3^{rd}$ deceleration.

In addition, the approximate entropy for the unsteady pressure acquired during the $3^{rd}$ sweep was also analyzed, and a spike in approximate entropy was observed as the first disturbance arrives during the deceleration, shown in FIG. 5. The spike in approximate entropy shows that approximate entropy is able to capture smaller nonlinear disturbances in the compression system. Furthermore, in the present study case, there is a ten-second interval during the 3rd deceleration and eight-second interval during the $4^{th}$ deceleration between the occurrence of the first disturbance and later fully developed high-frequency stall, thus indicating the potential of using approximate entropy for stall warning in aero engines.

Multistage Axial Compressor with Both Modal- and Spike-Types of Rotating Stall

Figure 6:
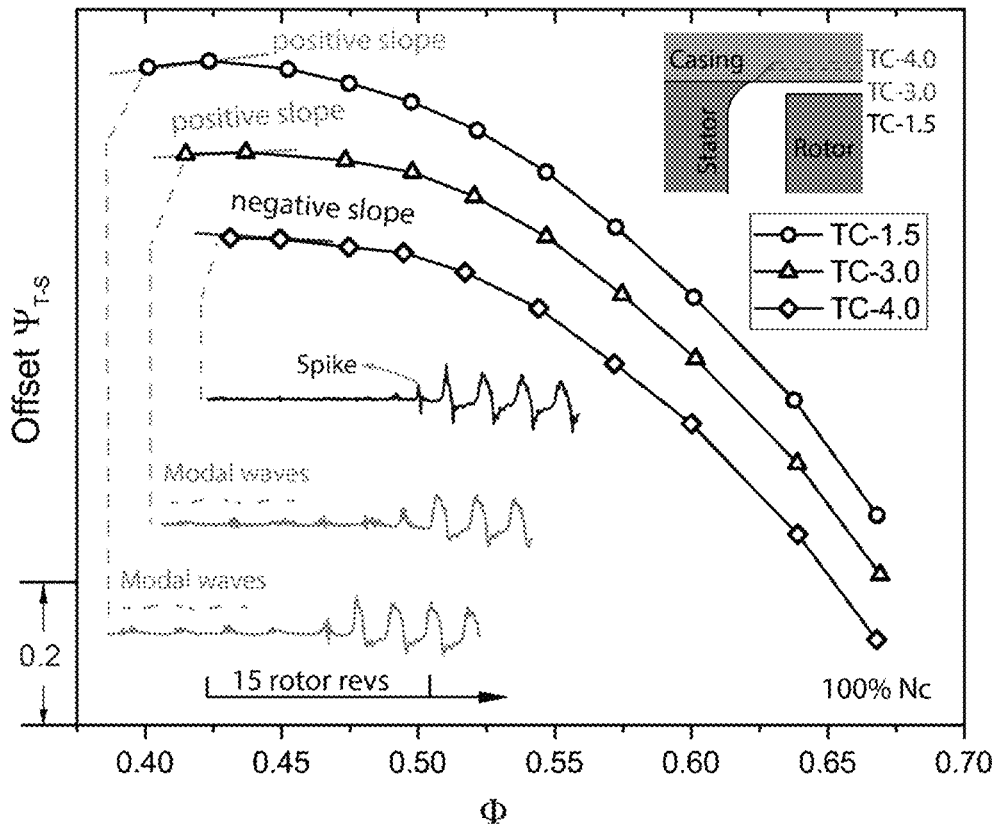
FIG. 6 illustrates stage 1 static pressure characteristic and representative stall signatures at the three tested tip clearance configurations.

In addition to the high-speed centrifugal compressor, the algorithm is also applied to a multi-stage axial compressor with both modal- and spike-type stall inception. The compressor features an inlet guide vane (IGV) and three stages that model the rear stages of a high-pressure core compressor. The design speed of the compressor is 5000 rpm, which produces an appreciable density rise at design point (on the order of 8% per stage). Details of the compressor research facility can be found in Berdanier, R. A., and Key, N. L., 2015, "An Experimental Investigation of the Flow Physics Associated with End Wall Losses and Large Rotor Tip Clearances as Found in the Rear Stages of a High Pressure Compressor," NASA Report No. CR 2015-218868. The data set used for analysis presented herein was in a previous test campaign conducted by Berdanier et al. to better understand the effects of large rotor tip clearances on small-core compressor overall performance and operability. Experiments were conducted and detailed measurements were acquired at three rotor tip clearance configurations including 1.5, 3.0, and 4.0% span. The rotor tip clearance was adjusted using separate casings with different depths of recesses over the rotor, as shown in FIG. 6. Three sets of fast-response pressure transducers were flush-mounted into the outer diameter of the flow path at an axial position of 15% axial chord upstream of each rotor. At each axial location, six sensors were placed circumferentially around the compressor. Additionally, an axial array of sensors was also installed at a selected circumferential location over each rotor and distributed axially 15% axial chord upstream of the rotor leading edge to 15% axial chord downstream of the rotor trailing edge. Instrumentation details can be found in Berdanier, R. A., and Key, N. L., 2018, "Effects of Tip Clearance on Stall Inception in a Multistage Compressor," J. Propul. Power, 34 (2), pp. 308-317.

Different from the stall experienced by the centrifugal compressor during speed transients, the stall inception measurements on this three-stage axial compressor were acquired using a quasi-steady approach. At a particular corrected speed, the stall point was mapped by closing the throttle in incremental steps to increase the loading of the compressor. After the throttle was adjusted, the compressor was allowed to reach a steady state operation. When the compressor was sufficiently close to stall (as determined from an a priori stall test to map out the flow rate where stall occurs), the fast-response measurements were continuously recorded at a sample rate of 100 kHz and low-pass filtered at 40 kHz as the throttle was slowly closed. This allowed the capture of pre-stall activity, as well as stall inception. Detailed analysis of the tip clearance effects on stall inception can be found in Ref. 18. A few key findings can be summarized: 1) for this compressor, stage 1 is always the limiting stage, which was indicated by the consistent roll-over in the stage 1 static-to-static characteristics and also supported by the unsteady pressure measurements; 2) the compressor showed a change in pre-stall signature with changes in rotor tip clearance. At design speed (100% Nc), the compressor has a strong pre-stall modal behavior at smaller rotor tip clearances (1.5 and 3% tip clearance) but is dominated by a spike-type stall at 4.0% tip clearance. A summary of stage 1 results, static pressure characteristic and representative stall signatures, at all the three tested tip clearance configurations are shown in FIG. 6.

Figure 7:
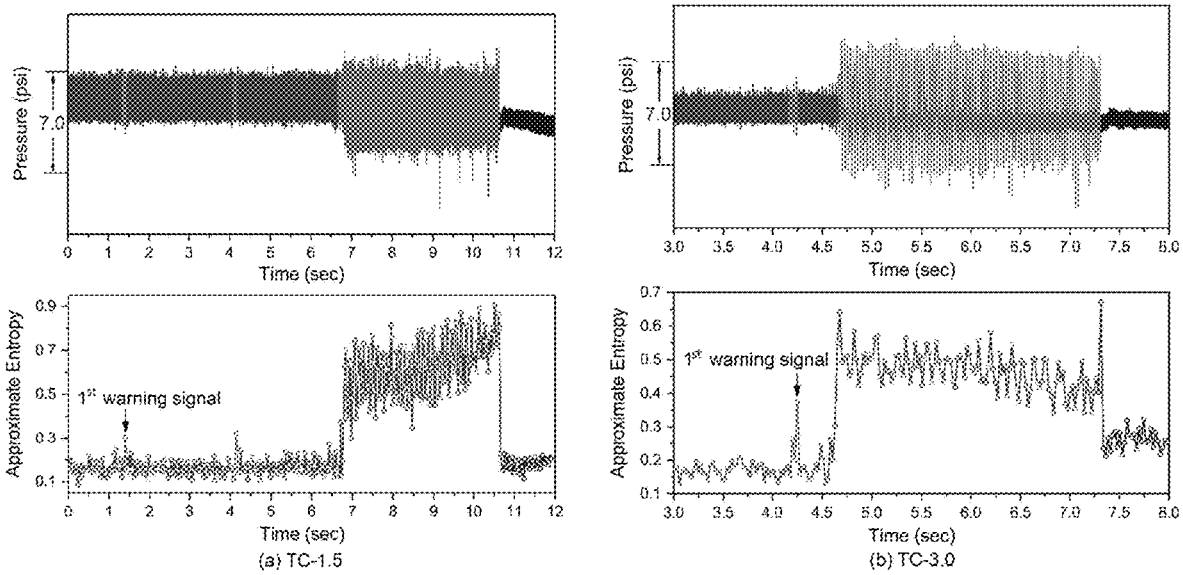
FIG. 7 illustrates instantaneous pressure traces over rotor 1 and the corresponding approximate entropy at 1.5% tip clearance (a), 3.0% tip clearance (b), and 4.0% tip clearance (c).
Figure 7:
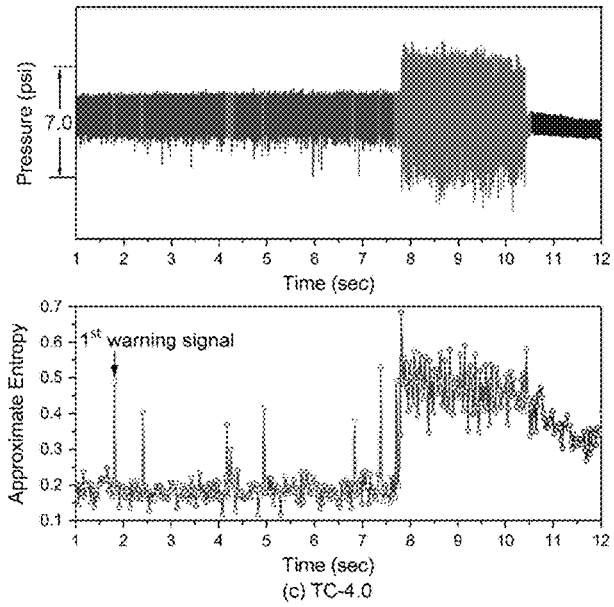

FIG. 7 shows the instantaneous pressure traces over Rotor 1 during stall inception and the corresponding approximate entropy. FIG. 7*a* shows the results acquired at 1.5% tip clearance, and results from 3.0% and 4.0% tip clearances are shown in FIGS. 7*b* and 7*c*. In all the three cases, the approximate entropy was evaluated using the same data size (2 rotor revolution), embedding dimension m=4, radius of similarity r=0.2σ, and AMI method for time delay calculation.

For all three tip clearance configurations, a significant increase in the magnitude of pressure traces and in the value of the calculated approximate entropy (as shown in red in the FIG. 7) occurred at compressor stall. In addition, pre-stall disturbances are detected using the approximate entropy parameter. Each pre-stall disturbance results in a peak in approximate entropy, shown in dark yellow in the figure. For example, the first disturbance during one stall inception campaign conducted at 1.5% tip clearance appears approximately 5-seconds prior to stall and results in a 75% increase in approximate entropy, as shown in FIG. 7*a*. Similarly, the first pre-stall disturbance observed in the 4.0% tip clearance configuration with spike-type stall occurs approximately 6-seconds prior to stall and results in an almost 200% increase in approximate entropy, as indicated in FIG. 7*c*. These peaks in approximate entropy prior to compressor stall show the potential utility of using approximate entropy for pre-stall disturbance detection and stall warning.

Considerations for Selection of N, m, r, & $t_d$

As discussed in the previous section, there are four parameters involved in evaluating the approximate entropy including: data size, N, embedding dimension, m, time delay, $t_d$, and radius of similarity, r. Intelligent choices of these parameters must be exercised in implementing approximate entropy for optimal extraction of flow disturbances. In this section, the influence of each parameter is presented using the data set acquired on the high-speed centrifugal compressor. Considerations and recommended guidelines for selecting the individual parameter are provided.

Considerations for Selection of N

The considerations for selection of the data size N are twofold: N needs to be large enough to represent the true correlation of the time series while being smaller than the number of data points involved during a disturbance to avoid saturation of the "stranger" attractor. Thus, the selection of an optimal number of data requires a two-step analysis. In the present study, the data size is described in terms of rotor revolutions, and its value for a single rotor revolution at 90% speed is approximately 1300. The parameter used in the present study to determine the minimum number of data is the widely used correlation integral, and its definition is:

$$C(m, N, r, t) = \frac{2}{M(M-1)} \sum_{1 \le i < j \le M}^{M} \Theta(r - \|x_k - x_j\|), \tag{6}$$

Figure 8:
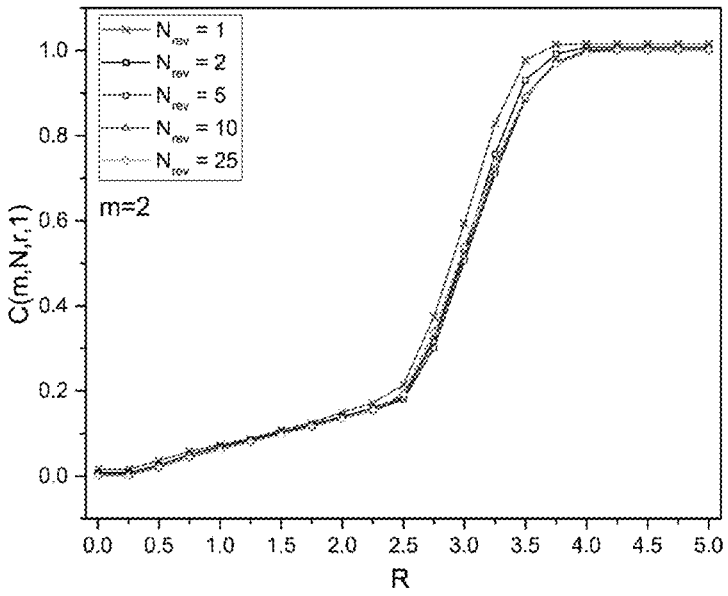
FIG. 8 illustrates correlation integral for a variety of data sets during stable operating condition.

FIG. 8 shows the distribution of C(m, N, r, 1) for a variety of data sizes ranging from $N_{rev}$=2 to $N_{rev}$=25 during stable operation with an embedding dimension of 2. For $N_{rev} \geq 5$, the distribution of $\Phi^m(r)$ remains nearly the same over the entire range for the selected radius of similarity with further increase in data size and, thus, indicates a data size greater than five rotor revolutions represents the true correlation of the time series. However, for $N_{rev} \leq 2$, C(m, N, r, 1) fails to represent the true correlation. It deviates slightly from the value at the same radius of similarity for $N_{rev} \geq 5$. In addition, the value of C(m, N, r, 1) is nearly 1 for r≥4σ, and this indicates that the distance between nearly every pair of two vectors in the constructed m-dimensional space is within four times of the standard deviation of data set.

Figure 9:
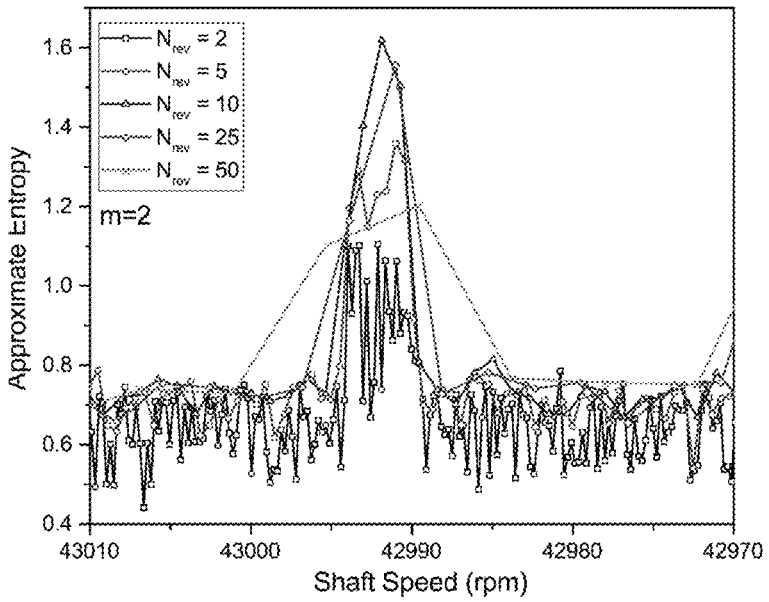
FIG. 9 illustrates influence of the number of data set on approximate entropy.

The second consideration is to avoid saturation of stranger extractor due to the large data sets. The approximate entropy of the unsteady pressure at the impeller LE over the duration of the first disturbance during the deceleration in the $4^{th}$ sweep is shown in FIG. 9 over a variety of selections for N. In an ideal case, each disturbance results in a single peak in approximate entropy. Thus, a selection of $N_{rev}$=10 or $N_{rev}$=25 gives a nice evolution of the disturbance. In both cases, it renders a single peak in approximate entropy and smooth ramp up and down as the disturbance arrives and leaves, respectively. However, a selection of larger data sets, i.e. $N_{rev}$=50, results in a substantial drop in approximate entropy (smaller peak) and less smooth transitions prior to and after the disturbance due to the smaller update rate in approximate entropy. Additionally, a smaller data size, i.e. $N_{rev}$=2, or $N_{rev}$=5, renders multiple peaks in approximate entropy but at a smaller magnitude during a single disturbance. Comparing to a single, dominant peak, these small multi-peaks may introduce false alarms and make it difficult to implement in real engine stall warning applications.

Considerations for Selection of m

Figure 10:
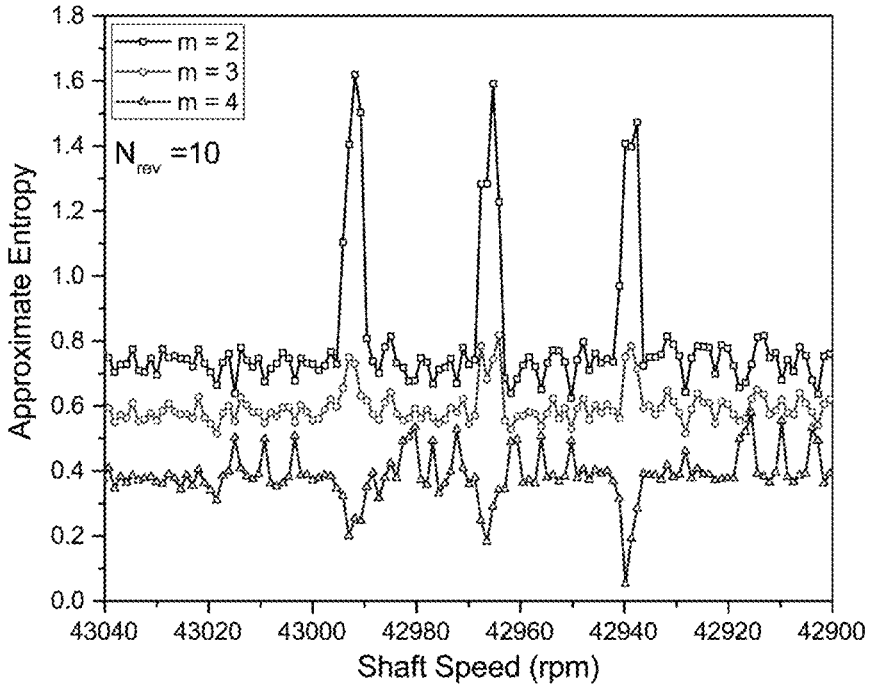
FIG. 10 illustrates influence of the embedding dimension on approximate entropy.

The influence of the embedding dimension was investigated, and the results are shown in FIG. 10. In the present study, an embedding dimension of m=2 provides the best extraction of the disturbance for the high-speed centrifugal compressor data set. This agrees with the study reported in Ref. 10, in which the same embedding dimension, m=2, was used to characterize compressor post-stall signatures using fractal dimensions. For the case m=3, the calculated approximate entropy within the duration of disturbances gets substantially attenuated compared to the case for m=2. Furthermore, a selection of m=4 results in small drops in approximate entropy as the disturbances occur and, thus, fails to capture the disturbances. Additionally, though the optimal embedding dimension may differ from application to application, the authors would recommend a default setting of m=2 for new designs with limited availability of historical data.

Considerations for Selection of r

Figure 11:
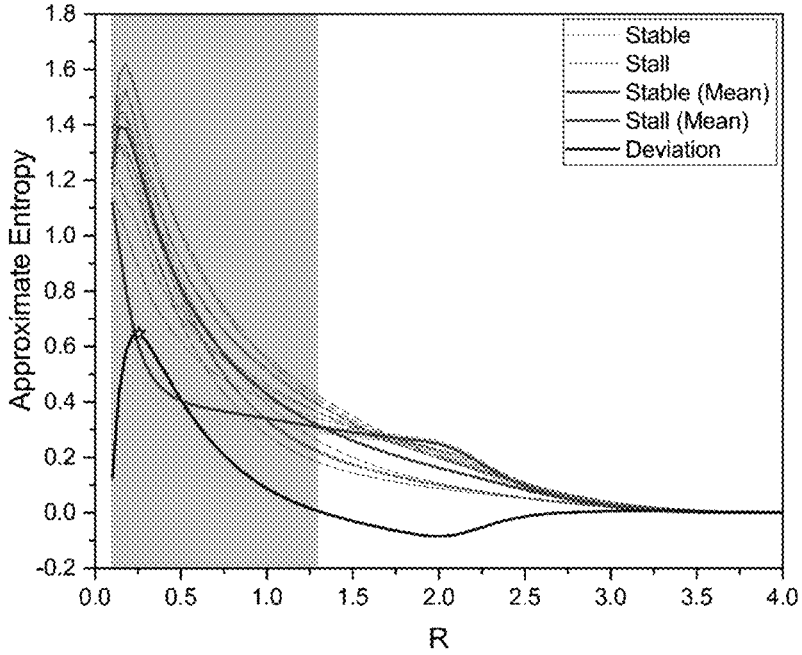
FIG. 11 illustrates influence of radius of similarity on approximate entropy.

The radius of similarity sets the threshold for the definition of a "stranger" and, thus, care must be taken to find an optimal value for each application. In general, a small value of r allows one to discern small levels of change in the system complexity, but this increase in sensitivity also comes at a price of reliability. For example, selection of a small r may detect flow irregularities associated with turbulence and render a low signal-to-noise ratio. FIG. 11 shows the distribution of approximate entropy over a wide range of radius of similarity $0.1\sigma \le r \le 4.0\sigma$. Both results from stable conditions (light grey lines) and the time period when flow instabilities occur (dark yellow lines). The distributions of approximate entropy during stable conditions (light grey lines) are very repetitive over the entire range of selected r. In contrast, the distributions of approximate entropy during the time period when disturbances occur (dark yellow lines) are different and much less repetitive compared with those from stable conditions. This decrease in repeatability for approximate entropy distribution during unstable conditions is caused by the transient behavior (develop and decay) of the disturbances.

Also, the averaged distributions of approximate entropy for both stable and unstable conditions are also shown in the FIG. 11 and are represented by the olive and red lines, respectively. The occurrence of disturbances results in higher approximate entropy for a radius of similarity ranging from $0.1\sigma$ to $1.3\sigma$, as indicated by the shaded area in the figure. The optimal choice for the similarity of radius is indicated as the peak of the delta averaged approximate distribution (blue lines). In the present study, the optimal radius of similarity is around one fourth of the standard deviation of the data set ($0.26\sigma$). However, it is worth noting that the optimal value for the radius of similarity is determined by both flow conditions at stable operation and the characteristics of disturbances associated with flow instability. Thus, the optimal radius of similarity can differ for different applications. Though it is recommended to perform the same analysis as shown in FIG. 11 for selection of the optimal radius of similarity, for applications without knowledge of the surge/stall signatures, an average approximate entropy is recommended. The average approximate entropy is defined as:

$$ApEn(m, N) = \frac{ApEn(0.1\sigma) + ApEn(0.2\sigma) + ApEn(0.5\sigma) + ApEn(1.0\sigma)}{4} \quad (7)$$

wherein the average approximate entropy is calculated from approximate entropy at four different radii of similarity including $r=0.1\sigma$, $0.2\sigma$, $0.5\sigma$, and $1.0\sigma$. A similar set for similarity of radius, $r=0.2\sigma$, $0.5\sigma$, $1.0\sigma$, and $2.0\sigma$, was used and provided good results.

Figure 12:
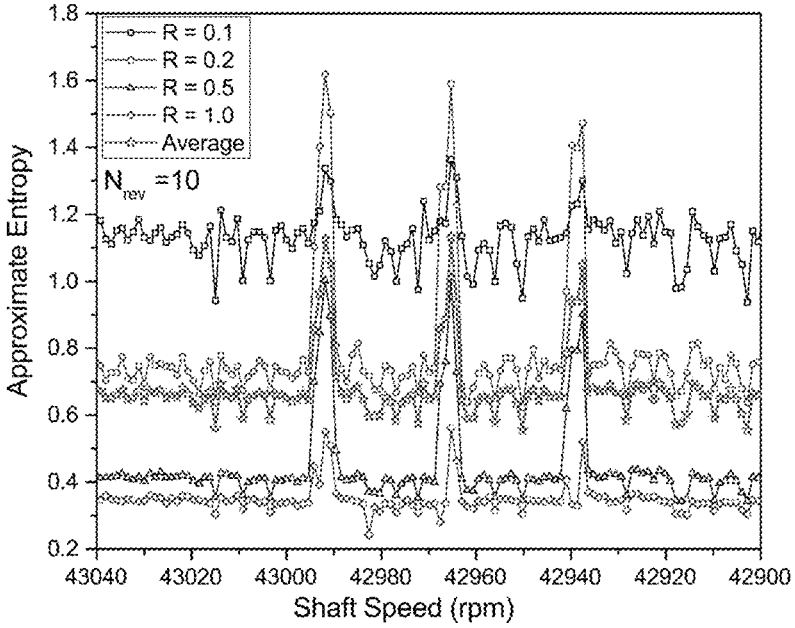
FIG. 12 illustrates effectiveness of average approximate entropy for disturbance detection.

To examine the effectiveness of the average approximate entropy, FIG. 12 shows the results of average and individual approximate entropy. Among the four selected radii of similarity, the choice of $r=0.2\sigma$ gives the largest magnitude of peak in approximate entropy as disturbances arrive. This agrees with the results shown in FIG. 11 that the optimal radius of similarity is $r=0.26\sigma$. Additionally, a selection of $r=0.5\sigma$ also gives good results in terms of the magnitude of the peak in approximate entropy as the disturbance arrives. However, the choices of $r=0.1\sigma$ or $r=1.0\sigma$ do not extract the disturbances well and give much smaller peaks in approximate entropy as disturbances arrive. As discussed previously, a selection of a small radius of similarity, $r=0.1\sigma$, may allow the detection of small flow irregularities due to turbulence, which agrees with the observation of higher level and larger fluctuations in approximate entropy for stable conditions. In contrast, a selection of an excessive radius of similarity $r=1.0\sigma$ does render smaller and more steady approximate entropy for stable conditions. However, it also filters out the relatively small irregularities associated with the disturbances and, thus, results in a smaller peak in approximate entropy during the appearance of disturbances. At last, the averaged approximate entropy (dark yellow stars) provides a good balance between the level of approximate entropy during stable conditions and the magnitude of peaks in approximate entropy. Therefore, it is recommended to use the average approximate entropy for applications without a priori knowledge of the compressor stall signatures.

Considerations for Selection of $t_d$

Figure 13:
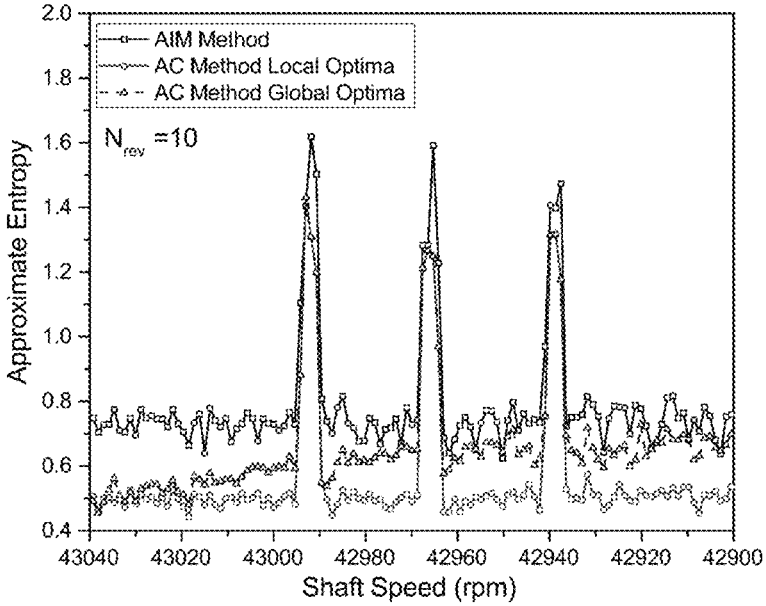
FIG. 13 illustrates influence of method for time delay calculation on approximate entropy.

As discussed in the previous section, the choice of time delay plays an important role in reconstructing the "stranger" attractor. The time delay could be obtained from either autocorrelation (AC) function or mutual information (MI) method. Although AC method requires less data and computational time, previous research has pointed out that it may not be appropriate for nonlinear systems and suggests using the first local minimum of the mutual information as the time delay. In the present study, the influences of both methods on the calculation of approximate entropy were investigated, and the results are shown in FIG. 13. The results shown in the figure were obtained using the same number of data $N_{rev}=10$, embedding dimension $m=10$, and radius of similarity $r=0.2\sigma$. The black squares are the approximate entropy calculated using the time delay obtained from the average mutual information (AMI) method, the olive circles are the approximate entropy based on the time delay selected as the first maxima (local maxima) from the autocorrelation function, and the blue triangles are the approximate entropy based on the time delay selected as the global maxima from the autocorrelation function. In general, the influence of the method utilized for obtaining the time delay in the present study is minor. All three approaches give similar magnitudes of peaks in approximate entropy as disturbances arrive. However, the time delay obtained from the AC method with global maxima introduces a small fluctuation, at a very low frequency, to the approximate entropy at stable operating conditions. This is indicated by the slow increase in approximate entropy during stable conditions. In contrast, the approximate entropy obtained using time delays from the AIM method and AC method with local maxima stays fairly constant for stable conditions.

CONCLUSIONS

Stall is a type of flow instability in compressors which sets the low flow limit for compressor operations. As a result of the damaging consequences, extensive research has been put toward stall inception, stall detection, and stall control. However, there is limited progress in developing a reliable stall warning or effective stall suppression system, which motivates the work presented in this disclosure.

The contributions of this disclosure are at least twofold. First, it introduces a new approach to identify the small disturbances prior to stall using nonlinear feature extraction algorithms. The method is different from the well-known stall warning techniques in the time domain including the correlation measure method and the ensemble-average method. The analysis of the new method is performed in phase space using the approximate entropy parameter. Approximate entropy is a measure of the amount of regularity and unpredictability of fluctuations in time-series data. In general, a time series with more repetitive patterns of fluctuations renders smaller approximate entropy and vice versa. A detailed procedure of the nonlinear feature extraction algorithm was presented. Furthermore, the method is applied to a high-speed centrifugal compressor, which experienced unexpected rotating stall during speed transients, and a multi-stage axial compressor, with both modal- and spike-type of stall. For both compressors, the signals from casing-mounted transducers were first reconstructed in the phase domain. Then, the approximate entropy for the phase-reconstructed signal was evaluated. In both cases, the appearance of nonlinear disturbances, in terms of spikes in approximate entropy, occur prior to stall. The concurrent spike in approximate entropy with the occurrence of the pressure disturbance shows that the parameter is capable of capturing small disturbances in a compression system and also indicates the potential of using the approximate entropy parameter for stall warning in aero engines.

As with other stall warning techniques, the intelligent choice of several parameters must be exercised. To implement approximate entropy, there are four parameters involved including the number of data, N, embedding dimension, m, time delay, $t_d$, and radius of similarity, r. The influence of these four parameters on the effectiveness of approximate entropy for disturbance extraction was explored. Additionally, considerations and guidelines for selection of each individual parameter were also provided.

In summary, this disclosure introduces a new approach for identifying small pre-stall or surge disturbances using nonlinear feature extraction algorithms. Analysis of the unsteady pressure acquired at two compressor research facilities shows the potential of using approximate entropy for stall warning in gas turbine engines.

Those skilled in the art will recognize that numerous modifications can be made to the specific implementations described above. The implementations should not be limited to the particular limitations described. Other implementations may be possible.

We claim:

1. A method of detecting an imminent compressor stall, wherein the method comprises:

providing a compressor to be monitored;

providing a plurality of casing-mounted pressure transducer on the compressor to collect time-series data, wherein the time-series data is related to instantaneous pressure signal obtained by the casing-mounted pressure transducer;

collecting the time-series data;

applying a phase space reconstruction to the time-series data to generate a multi-dimensional space;

evaluating approximate entropy; and identifying a flow disturbance by the change of the approximate entropy to determine the imminent compressor stall, wherein the flow disturbance happens prior to the compressor stall and is used as a compressor stall warning signal.

2. The method of claim 1, wherein the flow disturbance comprises a nonlinear feature.

3. The method of claim 2, wherein the nonlinear feature of the disturbance is preserved in the instantaneous pressure signal acquired from said casing-mounted transducers.

4. The method of claim 1, wherein the flow disturbance used as a compressor stall warning signal can be detected using a nonlinear feature extraction algorithm.

5. The method of claim 4, wherein the nonlinear feature extraction algorithm comprises phase-space reconstruction and evaluation of approximate entropy.

6. The method of claim 5, wherein the phase space reconstruction is performed using inputs of a time delay ($t_d$) and an embedding dimension (m).

7. The method of claim 1, wherein the time-series data is a set of data of N-point $\{x_i\}$, i=1, 2, . . . , N, the multi-dimensional space obtained from a time-series data of N-point $\{x_i\}$, i=1, 2, . . . , N, is defined as:

$$x_k=(x_k, x_{k+t}, x_{k+2t} \ldots, x_{k+(m-1)t})$$

$$x_k \in R^m, k=1,2, \ldots M,$$

wherein m is embedding dimension, t is the index lag, and M=N−(m−1)t is the number of embedded points in m-dimensional space.

8. The method of claim 1, wherein the evaluating of the approximate entropy comprises use of four parameters selected from the group of data size (N) embedding dimension (m), time delay ($t_d$), and radius of similarity (r).

9. The method of claim 1, wherein the approximate entropy is calculated as:

$$\mathrm{ApEn}(m,r,N)=\Phi^m(r)-\Phi^{m+1}(r)$$

wherein:

$$\Phi^m(r) = \frac{1}{M}\sum_{k=1}^{M} \log C_k^m(r);$$

$$C_k^m = \frac{1}{M}\sum_{j=1}^{M} \Theta(r - \|x_k - x_j\|),$$

wherein $\Theta(a)=0$, if $a<0$, $\Theta(a)=1$, if $a\geq 0$; and $\|x_k-x_j\|=\max(|x_k(i)-x_j(i)|)$, k=1, 2, . . . m.

10. The method of claim 9, wherein the nonlinear disturbance used as a compressor stall warning signal results in a sudden change in the value of approximate entropy.

* * * * *